US005304391A

United States Patent [19]

Rantanen

[11] Patent Number: 5,304,391

[45] Date of Patent: Apr. 19, 1994

[54] METHOD FOR REGULATION OF THE MOISTURE PROFILE OF A PAPER OR BOARD WEB IN A FILM SIZE PRESS

[75] Inventor: Rauno Rantanen, Muurame, Finland

[73] Assignee: Valmet Paper Machinery Inc., Finland

[21] Appl. No.: 948,160

[22] Filed: Sep. 21, 1992

Related U.S. Application Data

[62] Division of Ser. No. 590,481, Sep. 28, 1990, Pat. No. 5,159,893.

[30] Foreign Application Priority Data

Oct. 9, 1989 [FI] Finland ..... 894790

[51] Int. Cl.[5] ..... B05D 1/28

[52] U.S. Cl. ..... 427/8; 427/211; 427/428; 118/712; 118/227; 118/249

[58] Field of Search ..... 427/8, 361, 365, 356, 427/211, 428; 118/712, 227, 249

[56] References Cited

U.S. PATENT DOCUMENTS

| | | | |
|---|---|---|---|
| 1,195,888 | 8/1916 | Wheelwright | 162/26 S |
| 3,647,525 | 3/1972 | Dahlgren | 427/428 |
| 4,732,776 | 3/1988 | Boissevain | 118/407 |
| 4,848,268 | 7/1989 | Sollinger et al. | 118/227 |
| 4,957,770 | 9/1990 | Howarth | 118/419 |
| 4,966,093 | 10/1990 | Sommer | 118/419 |
| 5,045,342 | 9/1991 | Boissevain et al. | 427/8 |

FOREIGN PATENT DOCUMENTS

| | | | |
|---|---|---|---|
| 2103115 | 2/1983 | United Kingdom | 118/227 |

*Primary Examiner*—Shrive Beck
*Assistant Examiner*—Katherine A. Bareford
*Attorney, Agent, or Firm*—Steinberg, Raskin & Davidson

[57] ABSTRACT

The invention concerns a method for regulation of the moisture profile of a paper or board web in a size press in which the paper or board web (W) is made to run through a nip (N) formed by the rolls (1,2) in the size press. Films ($F_1$,$F_2$) of size are applied to the faces (3,4) of the rolls in the size press by means of coating devices (10,20) so that these films ($F_1$ $F_2$) of size are transferred onto the paper or board web (W) in the roll nip (N). A size ($F_1$) of substantially invariable profile is spread onto the face (3) of the first roll in the size press (5), and the profile of the size film ($F_2$) to be spread onto the face (4) of the second roll is regulated so that the moisture profile of the web (W) at the reel-up can be made substantially invariable. The invention also concerns a film size press for implementing the method.

5 Claims, 2 Drawing Sheets

METHOD FOR REGULATION OF THE MOISTURE PROFILE OF A PAPER OR BOARD WEB IN A FILM SIZE PRESS

This is a division of application Ser. No. 07/590,481, filed Sep. 28, 1990, now U.S. Pat. No. 5,159,893.

BACKGROUND OF THE INVENTION

The invention concerns a method for regulation of the moisture profile of a paper or board web in a size press in which the paper or board web is made to run through a nip formed by the rolls in the size press, films of size being applied to the faces of the rolls in the size press by means of coating devices so that said films of size are transformed onto the paper or board web in the roll nip.

The invention also concerns a film size press, comprising a nip formed by a pair of rolls, through which nip the paper or board web is made to run and in which the rolls in the pair of rolls are provided with coating devices for spreading of size films onto the faces of said rolls, from which faces the size films are arranged to be transferred in the roll nip onto the paper or board web.

In surface sizing of paper and board, commonly a so-called short-dwell technique is used so that by means of a coating device thin size films are applied to the faces of the rolls in the size press, these size films being transferred onto the paper in the roll nip. As the members of application of the size film, as a rule, either a blade or a threaded bar or further refinements of these members are used. In blade smoothing, the thickness of the size film and, consequently, the moisture profile of the web can be regulated by altering the blade pressure. When a threaded bar is used, the thickness of the size film is regulated by varying the groove profile in the bar. In size presses, one of the most difficult problems has been the exact control of the moisture profile of the size film. By means of bar coaters, automatic regulation of the moisture profile cannot be achieved at all, because for regulation it is always necessary to replace the bar. In the blade coating technique the regulation of the moisture profile has also been very difficult, for example, because it is not always known from which side the regulation ought to be carried out.

SUMMARY OF THE INVENTION

The object of the present invention is to provide a method as well as a film size press that carries out the method by whose means the drawbacks related to the devices currently in use are avoided and by whose means automatic regulation of the moisture profile of the web can be carried out simply and easily. In view of achieving this, the method in accordance with the invention comprises the steps of spreading a size film of substantially invariable profile onto the face of the first roll in the size press, and regulating the profile of the size film to be spread onto the face of the second roll so that the moisture profile of the web at the reel-up can be made substantially invariable.

On the other hand, the film size press in accordance with the invention comprises a coating device for the first roll which spreads a size film of substantially invariable profile and a coating device for the second roll which is adjustable such that the moisture profile of the web at the reel-up can be made substantially invariable.

The most important advantage of the invention, compared with the prior art solutions, is that in the invention the moisture profile can be brought under automatic control without making the construction of the equipment more complicated than at present. The invention can be applied to existing film size presses in a simple way, and an application of the invention to existing structures does not substantially increase the cost of the equipment. Further advantages and characteristic features of the invention will become apparent from the following detailed description of the invention.

BRIEF DESCRIPTION OF THE DRAWINGS

In the following, the invention will be described in detail with reference to the Figures in the accompanying drawing.

DETAILED DESCRIPTION OF THE INVENTION

Figure 1:
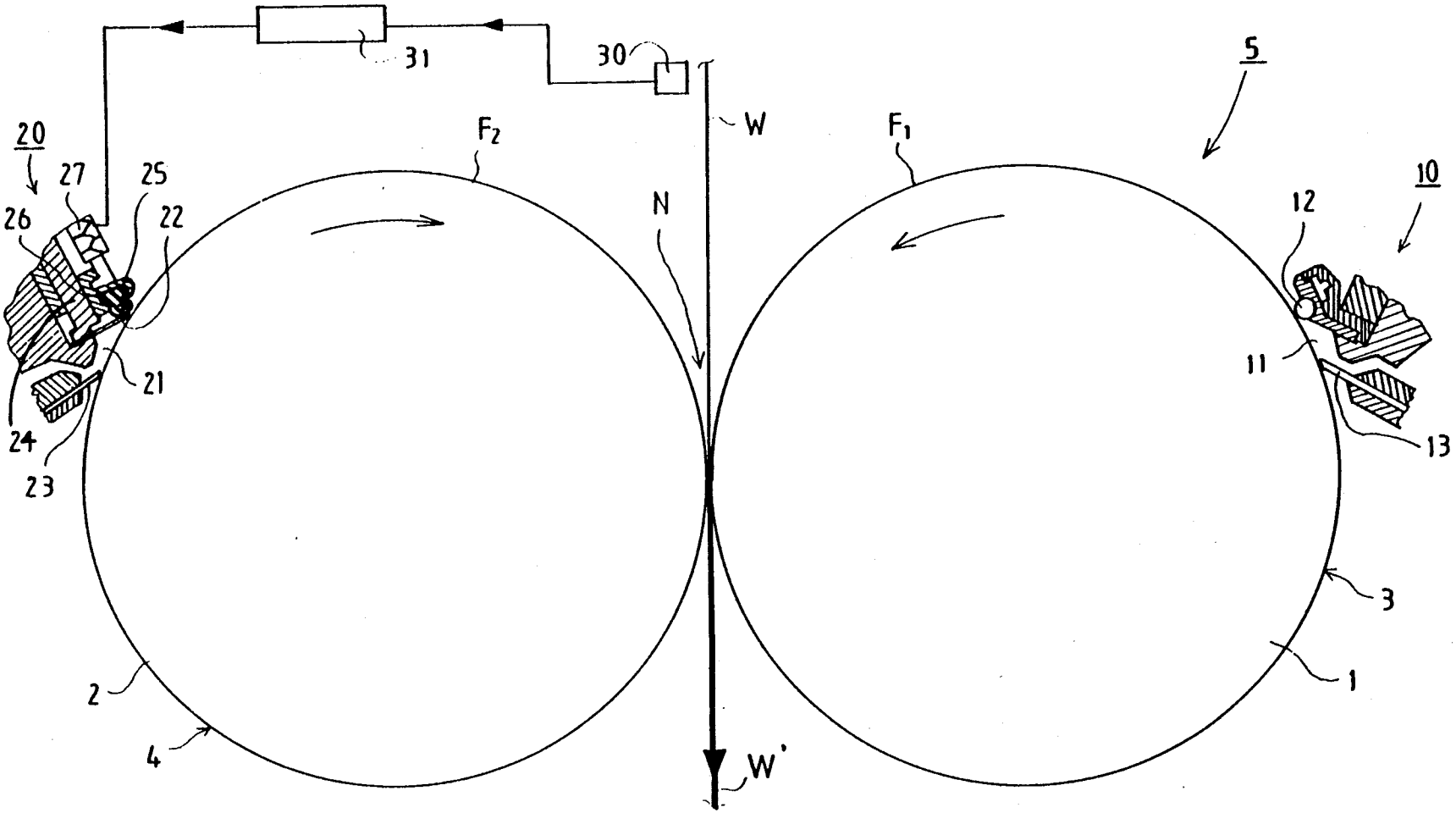
FIG. 1 is a fully schematical side view of a film size press in which the method and the device in accordance with the invention are illustrated.

In FIG. 1, the film size press is denoted generally with the reference numeral 5. The film size press 5 comprises size-press rolls 1 and 2 so that the first roll 1 and the second roll 2 form a nip N with each other through which nip the paper or board web W is passed by conventional means such as from a dryer section of a paper making machine. In the film size press 5, a first size film $F_1$ is applied onto the face 3 of the first roll by means of the first coating device 10, and in a corresponding way a second size film $F_2$ is applied onto the face 4 of the second roll by means of the second coating device 20. In the roll nip N the size films $F_1$ and $F_2$ are transferred onto the paper or board web W that runs through the nip.

In the film size press 5 shown in FIG. 1, as the first coating device 10 a conventional rod coater is used, which comprises a pressurized coating agent chamber 11, into which the coating agent is fed under pressure. In the rod coater 10 the coating agent chamber 11 is defined between the front wall 13 and the edge seals (not shown) of the chamber as well as the coating rod 12 acting as the smoothing member. The coating rod 12 can be, in the conventional manner, for example, a threaded bar, which is fitted in its cradle to be rotated by means of a drive gear.

Figure 2:
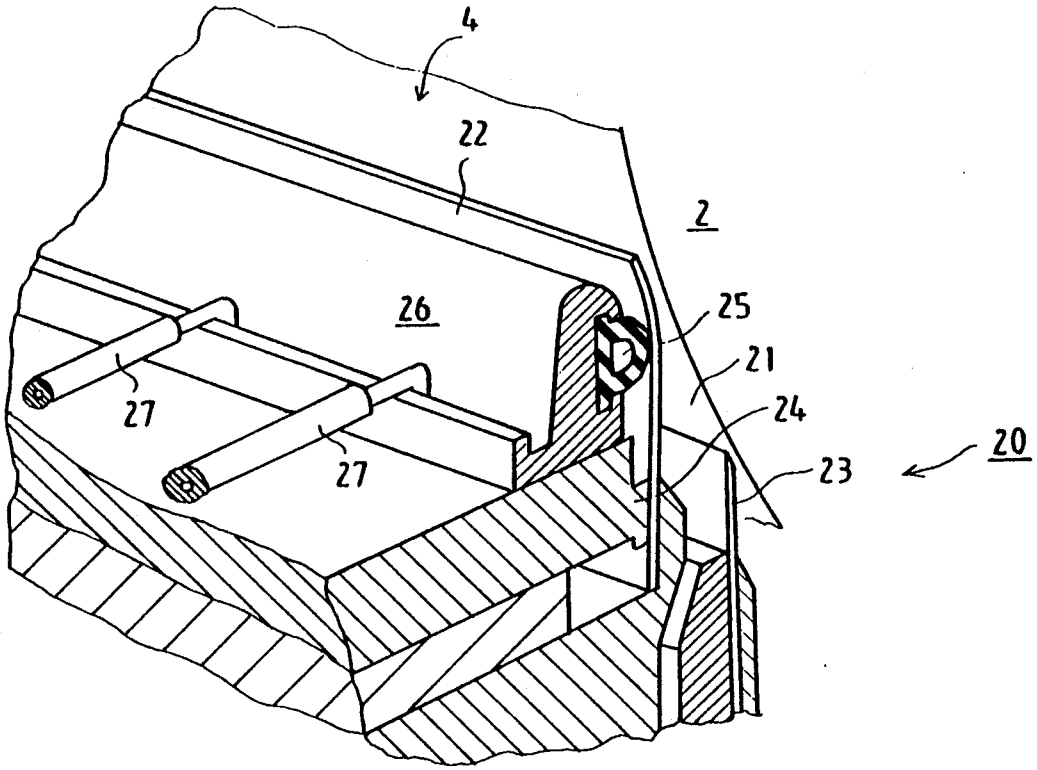
FIG. 2 is a schematic perspective view of a blade coater used in the size press.

In the film size press 5, as the second coating device 20 a blade coater is used, which is also shown in more detail in FIG. 2. The blade coater 20 comprises a coating agent chamber 21, into which the coating agent is introduced under pressure. The coating agent chamber 21 is defined by the coating blade 22, the front wall 23 of the coating agent chamber as well as the edge seals (not shown). In the conventional manner, the coating blade 22 is fitted in a blade holder 24, and the coating blade 22 is loaded against the face 4 of the roll 2 by means of a loading member, such as the loading hose 25 shown in the Figures. In the arrangement in accordance with the invention, the loading hose 25 is mounted in a support rib 26, and a number of regulation spindles 27 are arranged to act upon the support rib 26, which spindles are mounted to be sufficiently densely spaced in the transverse direction of the machine, for example with a spacing of 10 cm. The regulation spindles 27 are motor operated so that each regulation spindle 27 can be controlled individually in accordance with given guide and control values. Thus, by means of these regulation spindles 27, the support rib 26 is bent in a desired way so as to regulate the moisture profile of the web W.

The web W arrives in the film size press 5 such that its moisture profile is not constant, but it may show considerable variation. This is why it is necessary to control the moisture profile of the web W in some way, in the film size press 5. In the system in accordance with the invention, this has been arranged so that in connection with the film size press 5 detectors 30 are provided, which measure the moisture of the web W before reeling up of the dried web. A number of detectors 30 are fitted in the transverse direction of the web W, these detectors being placed to be spaced at certain intervals so that they render it possible to determine the moisture profile of the web W before it arrives at the reel-up. The detectors 30 feed the, measured moisture values of the web W to control unit 31, which converts these values to suitable regulation quantities and feeds these regulation quantities to the motors of the regulation spindles 27. Thus, based on these regulation quantities, the regulation spindles 27 regulate the profile of the coating blade 22 and thereby the profile of the size film $F_2$ applied to the face 4 of the second roll. Since the profile of the first size film $F_1$ is substantially invariable, the moisture profile of the web W at the reel-up is corrected in the roll nip N and made substantially invariable exclusively by regulating the profile of the second size film $F_2$ alone. Thus, in the invention, the regulation of the moisture profile of the web W is accomplished in a very simple and reliable way.

Thus, in the method of the invention, in the film size press 5, a size layer of invariable profile is applied to one face of the web W, whereas, onto the opposite face of the web W, a size layer is applied whose profile is regulated so that the moisture profile of the web W' is brought to the desired, invariable level. The film size quantities applied by means; of coating devices vary, as a rule, within a range of 10 to 30 g/m$^2$. Thus, by means of film size regulation in accordance with the invention, it is easy to make the moisture profile of the web W invariable.

The invention has been described hereinbefore by way of example with reference to the Figures in the accompanying drawing. The invention is, however, not confined to the exemplifying embodiment shown in the Figures alone, but many variations are possible within the scope of the inventive idea defined in the accompanying patent claims.

What is claimed is:

1. A method for regulating the moisture profile of a paper or board web in a film size press, said method comprising the steps of:

feeding a coating agent into a pressurized coating agent chamber in a first coating device;

applying a first film of coating agent of substantially constant profile from said chamber in said first coating device to a first press roll in a film size press;

feeding a coating agent into a second pressurized coating agent chamber in a second coating device;

applying a second film of coating agent of variable profile from said second chamber in said second coating device to a second press roll in said film size press;

regulating the profile of said second film of coating agent in accordance with a desired moisture profile of said web;

passing said web through a press nip formed by said first and second press rolls whereby said web emerging from said nip has substantially said desired moisture profile;

measuring the moisture profile of the web at a location in the path of the web before the web reaches said press nip; and adjusting the variable profile of said second coating device in relation to the measured moisture profile of the web such that the moisture profile of the web at said nip remains substantially invariable.

2. The method of claim 1, further comprising using a blade coater to regulate said profile of said second film of coating agent.

3. The method of claim 2, further comprising using loading means connected to said blade coater to adjust said blade coater to regulate said profile of said second film of coating agent.

4. The method of claim 1, further comprising using a rod coater to spread said first film of coating agent onto said first press roll.

5. The method of claim 1, wherein said first and second coating agents are size.

* * * * *